US008414104B2

(12) United States Patent
Shimizu

(10) Patent No.: US 8,414,104 B2
(45) Date of Patent: Apr. 9, 2013

(54) RECORDING APPARATUS AND WIPING DEVICE

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 130 days.

(21) Appl. No.: 13/033,557

(22) Filed: Feb. 23, 2011

(65) Prior Publication Data

US 2011/0205295 A1 Aug. 25, 2011

(30) Foreign Application Priority Data

Feb. 23, 2010 (JP) ..... 2010-036970

(51) Int. Cl.
*B41J 2/165* (2006.01)

(52) U.S. Cl.
USPC ..... 347/33; 347/29; 347/32

(58) Field of Classification Search ..... 347/8, 9, 347/14, 20, 22, 29, 32–34, 40, 42, 49
See application file for complete search history.

(56) References Cited

U.S. PATENT DOCUMENTS

| | | | | |
|---|---|---|---|---|
| 2005/0264601 | A1 | 12/2005 | Park | |
| 2008/0198196 | A1 | 8/2008 | Chikamoto | |
| 2010/0207991 | A1 * | 8/2010 | Koizumi | 347/32 |

FOREIGN PATENT DOCUMENTS

| | | | |
|---|---|---|---|
| JP | 2001-063075 | A | 3/2001 |
| JP | 2001-301183 | A | 10/2001 |
| JP | 2005-161796 | A | 6/2005 |
| JP | 2005-335388 | A | 12/2005 |
| JP | 2008-200849 | A | 9/2008 |

* cited by examiner

*Primary Examiner* — Thinh Nguyen
(74) *Attorney, Agent, or Firm* — Baker Botts L.L.P.

(57) ABSTRACT

A recording apparatus may comprise a recording head which has an ejection surface, and a wiping device configured to move in a wiping direction. The wiping device may comprise a wiper and a wiper holder. The wiping device may comprise a cam mechanism configured to support the wiper holder and change the height of the wiper holder, such that the wiper is positioned at a contacting height when the cam mechanism is moving in the wiping direction, and such that the wiper is positioned at a separation height when the cam mechanism is moving in the retracting direction. The wiping device may comprise a guide mechanism. The wiping device may comprise a moving device configured to move the wiper and the wiper holder together with the cam mechanism by moving the cam mechanism selectively in either the wiping direction or a retracting direction.

4 Claims, 7 Drawing Sheets

RECORDING APPARATUS AND WIPING DEVICE

CROSS REFERENCE TO RELATED APPLICATION

This application claims priority to Japanese Patent Application No. 2010-036970, filed Feb. 23, 2010, the entire subject matter and disclosure of which is incorporated herein by reference.

BACKGROUND OF THE DISCLOSURE

1. Filed of the Disclosure

The features described herein relate to recording apparatuses for forming images on recording media, and wiping devices for wiping contaminants on ejection surfaces.

2. Description of the Related Art

A known ink jet printer includes an ink jet head, a frame moving mechanism for vertically moving the ink jet head, a maintenance unit for the ink jet head, and a horizontal movement mechanism for horizontally moving the maintenance unit. In this ink jet printer, the maintenance unit is horizontally moved to a position opposing the ink jet head after the ink jet head has been raised from a printing position to a head maintenance position. Then, after purge, the ink jet head is lowered so as to bring a wiper and an ejection surface of the ink jet head into contact with each other and wipe the ejection surface while the maintenance unit is horizontally moved toward a retracting position. Thus, the ink jet head may be recovered from an ejection failure.

However, in the ink jet printer described above, when the maintenance unit is horizontally moved to a position opposing the ink jet head, the ink jet head needs to be raised to the head maintenance position to avoid contact between the wiper and the ejection surface. Therefore, the ink jet printer has a space allowing vertical movement of the head, which increases the size of the printer in the height direction. Furthermore, not only a mechanism for horizontally moving the wiper, but also a mechanism for vertically moving the head, which uses another driving source, is required. Consequently, the number of components constituting these mechanisms is increased, further increasing the size of the printer and increasing the manufacturing costs due to increased component count.

SUMMARY OF THE DISCLOSURE

According to one embodiment described herein, a recording apparatus may comprise a recording head which has an ejection surface provided with ejection ports through which liquid is ejected, and a wiping device configured to move in a wiping direction along the ejection surface and wipe contaminants from the ejection surface. The wiping device may comprise a wiper. The wiping device may comprise a wiper holder configured to hold the wiper. The wiping device may comprise a cam mechanism configured to support the wiper holder and change the height of the wiper holder, such that the wiper is positioned at a contacting height at which the wiper is in contact with the ejection surface when the cam mechanism is moving in the wiping direction, and such that the wiper is positioned at a separation height at which the wiper is not in contact with the ejection surface when the cam mechanism is moving in the retracting direction opposite to the wiping direction. The wiping device may comprise a guide mechanism configured to support the cam mechanism so as to be slidable in the wiping direction. The wiping device may comprise a moving device configured to move the wiper and the wiper holder together with the cam mechanism by moving the cam mechanism selectively in either the wiping direction or a retracting direction.

According to another embodiment herein, a wiping device may be configured to wipe contaminants from an ejection surface provided with ejection ports through which liquid is ejected, by being moved in a wiping direction along the ejection surface. The wiping device may comprise a wiper. The wiping device may comprise a wiper holder configured to hold the wiper. The wiping device may comprise a cam mechanism configured to support the wiper holder and change the height of the wiper holder, such that the wiper is positioned at a contacting height at which the wiper is in contact with the ejection surface when the cam mechanism is moving in the wiping direction, and such that the wiper is positioned at a separation height at which the wiper is not in contact with the ejection surface when the cam mechanism is moving in the retracting direction opposite to the wiping direction. The wiping device may comprise a guide mechanism configured to support the cam mechanism so as to be slidable in the wiping direction. The wiping device may comprise a moving device configured to move the wiper and the wiper holder together with the cam mechanism by moving the cam mechanism selectively in either the wiping direction or a retracting direction.

Other objects, features, and advantages of embodiments of the present invention will be apparent to persons of ordinary skill in the art from the following description of embodiments with reference to the accompanying drawings.

DETAILED DESCRIPTION OF EMBODIMENTS

Various embodiments, and their features and advantages, may be understood by referring to FIGS. 1-7, like numerals being used for corresponding parts in the various drawings.

Figure 1:
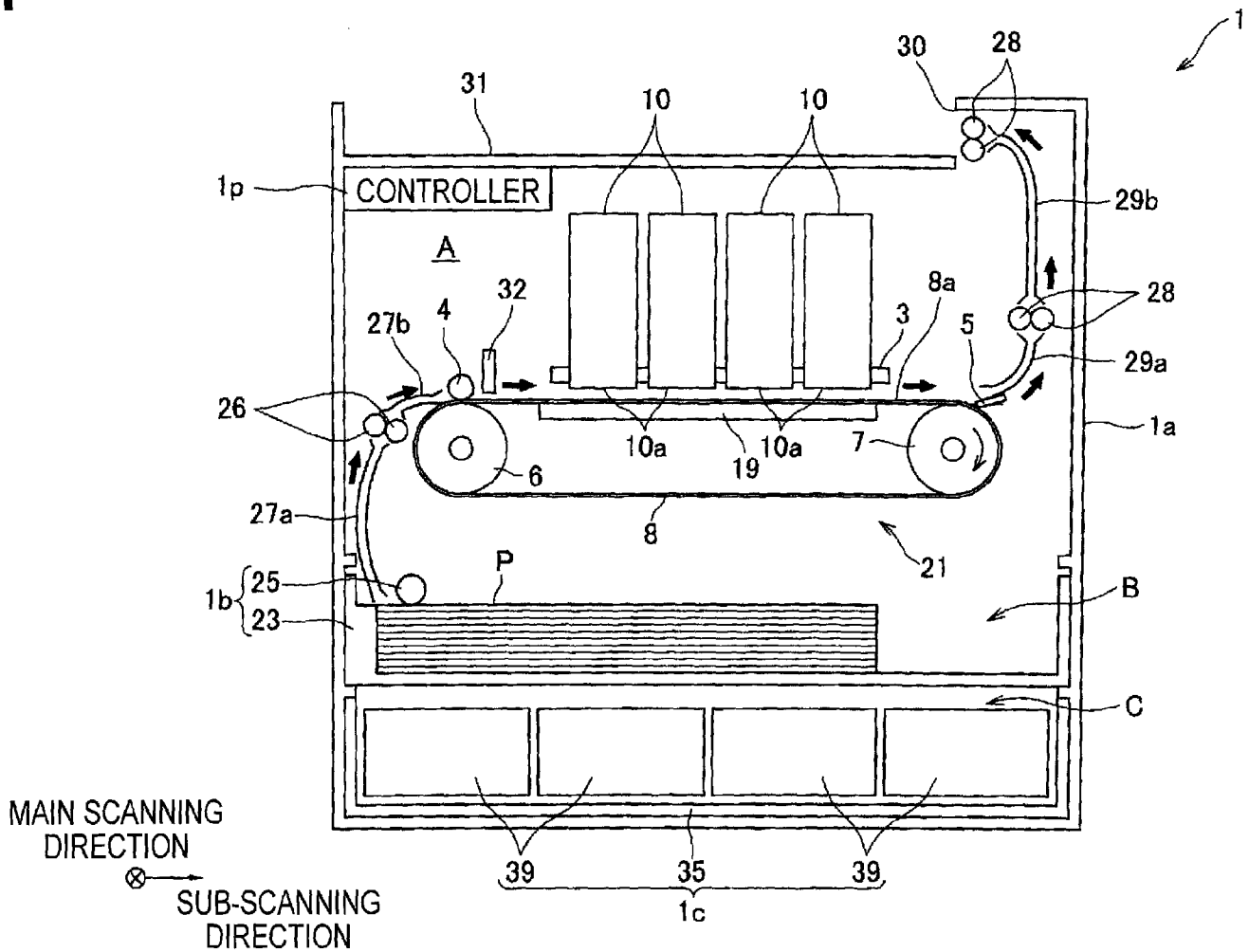
FIG. 1 is a schematic side view showing the inner structure of an ink jet printer according to an embodiment.

Referring to FIG. 1, the overall structure of an ink jet printer 1, which is an embodiment of a recording apparatus, will be described.

The printer 1 is a line-type color ink jet printer. The printer 1 includes a rectangular-parallelepiped-shaped casing 1*a*. A sheet-output portion 31 is provided on the top plate of the casing 1*a*. The inner space of the casing 1*a* may be divided into spaces A, B, and C from above. In the spaces A and B, a sheet-conveying path continuous with the sheet-output portion 31 is formed. In the space A, the conveyance of a sheet P and image formation on the sheet P are performed. In the space B, a sheet-feed operation is performed. The space C accommodates ink cartridges 39, which function as ink supply sources.

The space A accommodates a plurality of, e.g., four, ink jet heads 10 (hereinafter, "heads 10"), wiping devices 40 for wiping ejection surfaces 10*a* of the heads 10 (described below, see FIG. 2), a conveying unit 21 for conveying the sheet P, a guide member for guiding the sheet P, etc. A controller 1*p*, which controls the operation of the entire printer 1 by controlling the operation of the respective sections of the printer 1, is disposed at the top of the space A.

The plurality of, e.g., four, heads 10 are substantially rectangular-parallelepiped-shaped, which are elongated in the main scanning direction. The heads 10 are arranged at predetermined intervals in the sub-scanning direction and are supported by the casing 1*a* via a head frame 3. The heads 10 each include a stacked body consisting of a flow path unit having ink flow paths, including pressure chambers, and an actuator for applying pressure to ink in the pressure chambers (both of them are not shown). The bottom surfaces of the heads 10 function as the ejection surfaces 10*a*. The ejection surfaces 10*a* have a plurality of ejection ports (not shown) through which ink is ejected. During image formation, magenta, cyan, yellow, and black ink is ejected from the heads 10 onto the sheet P being conveyed.

The conveying unit 21 includes a nip roller 4, a separation plate 5, a plurality of, e.g., two, belt rollers 6 and 7, and an endless conveying belt 8 that is wound around and runs between the belt rollers 6 and 7. The belt roller 7, functioning as a driving roller, is rotated clockwise in FIG. 1 by a conveying motor (not shown), under the control of the controller 1*p*. The conveying belt 8 moves in the direction indicated by arrows in FIG. 1 as the belt roller 7 rotates. The belt roller 6, functioning as a driven roller, is rotated clockwise in FIG. 1 as the conveying belt 8 moves.

In the loop of the conveying belt 8, a plate-like platen 19 is disposed so as to oppose the ejection surfaces 10*a* of the plurality of, e.g., four, heads 10. The upper loop of the conveying belt 8 is supported by the platen 19 from inside, and a gap suitable for image formation is provided between an outer peripheral surface 8*a* and the ejection surfaces 10*a*.

A silicon layer having low-viscosity is formed on the outer peripheral surface 8*a* of the conveying belt 8. The sheet P fed to the conveying unit 21 by the guide member is pressed against the outer peripheral surface 8*a* by the nip roller 4 and is conveyed in the sub-scanning direction, as indicated by bold arrows.

The sheet P is then separated from the outer peripheral surface 8*a* by the separation plate 5 on the right side in FIG. 1. The sheet P separated from the outer peripheral surface 8*a* is conveyed upward by the guide member and is discharged onto the sheet-output portion 31 through an opening 30 provided at the top of the casing 1*a*.

The guide member includes an upstream guide portion and a downstream guide portion. The upstream guide portion connects a sheet-feed unit 1*b* and the conveying unit 21 and includes guides 27*a* and 27*b* and a feed roller pair 26. The downstream guide portion connects the conveying unit 21 and the sheet-output portion 31 and includes guides 29*a* and 29*b* and a plurality of, e.g., two, feed roller pairs 28. Each of the feed roller pairs 26 and 28 are rotated by feed motors (not shown), under the control of the controller 1*p*.

The sheet-feed unit 1*b* is disposed in the space B such that it can be attached to or removed from the casing 1*a* in the main scanning direction. As shown in FIG. 1, the sheet-feed unit 1*b* includes a sheet-feed tray 23 for storing the sheet P, and a sheet-feed roller 25 attached to the sheet-feed tray 23. The sheet-feed tray 23 is an open-top box and can store a plurality of sheets P. The sheet-feed roller 25 is rotated by a sheet-feed motor (not shown) to feed the sheet P at the top in the sheet-feed tray 23, under the control of the controller 1*p*.

The sheet P fed by the sheet-feed roller 25 is sent to the conveying unit 21 by the feed roller pair 26, along the guides 27*a* and 27*b*. The sheet P is conveyed along the conveying belt 8 by the rotation of the belt roller 6. An image is formed on the sheet P during conveyance. Then, the sheet P having undergone image formation is conveyed upward by the feed roller pairs 28 along the guides 29*a* and 29*b*. Finally, the sheet P is discharged onto the sheet-output portion 31 through the opening 30 provided at the top of the casing 1*a*. In this manner, the sheet conveying path extending from the sheet-feed unit 1*b* to the sheet-output portion 31 is formed in the printer 1.

Herein, the "sub-scanning direction" is the direction parallel to the direction in which the sheet P is conveyed by the conveying unit 21, and the "main scanning direction" is the direction parallel to the horizontal plane and perpendicular to the sub-scanning direction. The main scanning direction and the sub-scanning direction are both parallel to the horizontal plane (the ejection surfaces 10*a* of the heads 10) and perpendicular to the vertical plane.

An ink unit 1*c* is disposed in the space C such that it can be attached to or removed from the casing 1*a* in the main scanning direction. The ink unit 1*c* includes a cartridge tray 35 and a plurality of, e.g., four, cartridges 39. The plurality of, e.g., four, cartridges 39 contain each of magenta ink, cyan ink, yellow ink, and black ink. These cartridges 39 are stored side-by-side in the sub-scanning direction in the tray 35.

The controller 1*p* disposed in the space A includes a central processing unit (CPU) functioning as an arithmetic processing unit, a read only memory (ROM) that stores programs executed by the CPU and data used in executing the programs, a random access memory (RAM) that temporarily stores data necessary to execute the programs, an input/output interface that sends the data to or receives the data from an outer device connected to the printer 1. The controller 1*p* receives image data of an image to be recorded on the sheet P from a personal computer (PC), functioning as the outer device, through the interface, and stores the image data in the RAM. The controller 1*p* controls the conveyance of the sheet P and the recording on the sheet P, on the basis of the image data stored in the RAM.

The controller 1*p*, upon receipt of a recording instruction, activates the entire conveying path. More specifically, the controller 1*p* first drives the conveying motor to rotate the belt roller 6 and stands by until the moving speed of the conveying belt 8 stabilizes at a predetermined speed. During the standby, the controller 1*p* converts the image data contained in the recording instruction into recording data compatible with the arrangement of the ejection ports and stores the data in a predetermined region of the RAM. Once the moving speed of the conveying belt 8 has stabilized at a predetermined speed, the controller 1*p* drives the sheet-feed motor and the feed motors to rotate the sheet-feed roller 25 and the feed roller pairs 26 and 28, sequentially feeding the sheets P to the conveying unit 21. A sheet sensor 32 is positioned downstream of the nip roller 4 in the sheet conveying direction. The controller 1*p* determines the timing at which ink is ejected from the heads 10, on the basis of a detection signal received from the sensor 32. When the sheet P passes immediately below the ejection surfaces 10*a*, ink droplets are ejected from the ejection ports, on the basis of the recording data. Thus, a desired color image is formed on the sheet P. Thereafter, the sheet P is sent to the sheet-output portion 31 by the feed roller pairs 28.

Herein, contaminants, such as ink, paper dust, and particles, are deposited on the ejection surfaces 10*a* with time, and ink in the less frequently used ejection ports becomes viscous. Because these situations degrade the ink ejection performance, the controller 1*p* performs processing for recovering the ejection performance (maintenance) periodically or every time a predetermined number of sheets have undergone recording. The maintenance includes purge, in which ink is forcibly discharged from the ejection ports by driving a pump, and wiping, in which contaminants such as ink on the ejection surfaces 10*a* are removed using a wiper 41 after the purge.

Next, referring to FIGS. 2 to 7C, the wiping devices 40 will be described. Note that the head frame 3 is not shown in FIGS. 2, 4, and 7.

Figure 2:
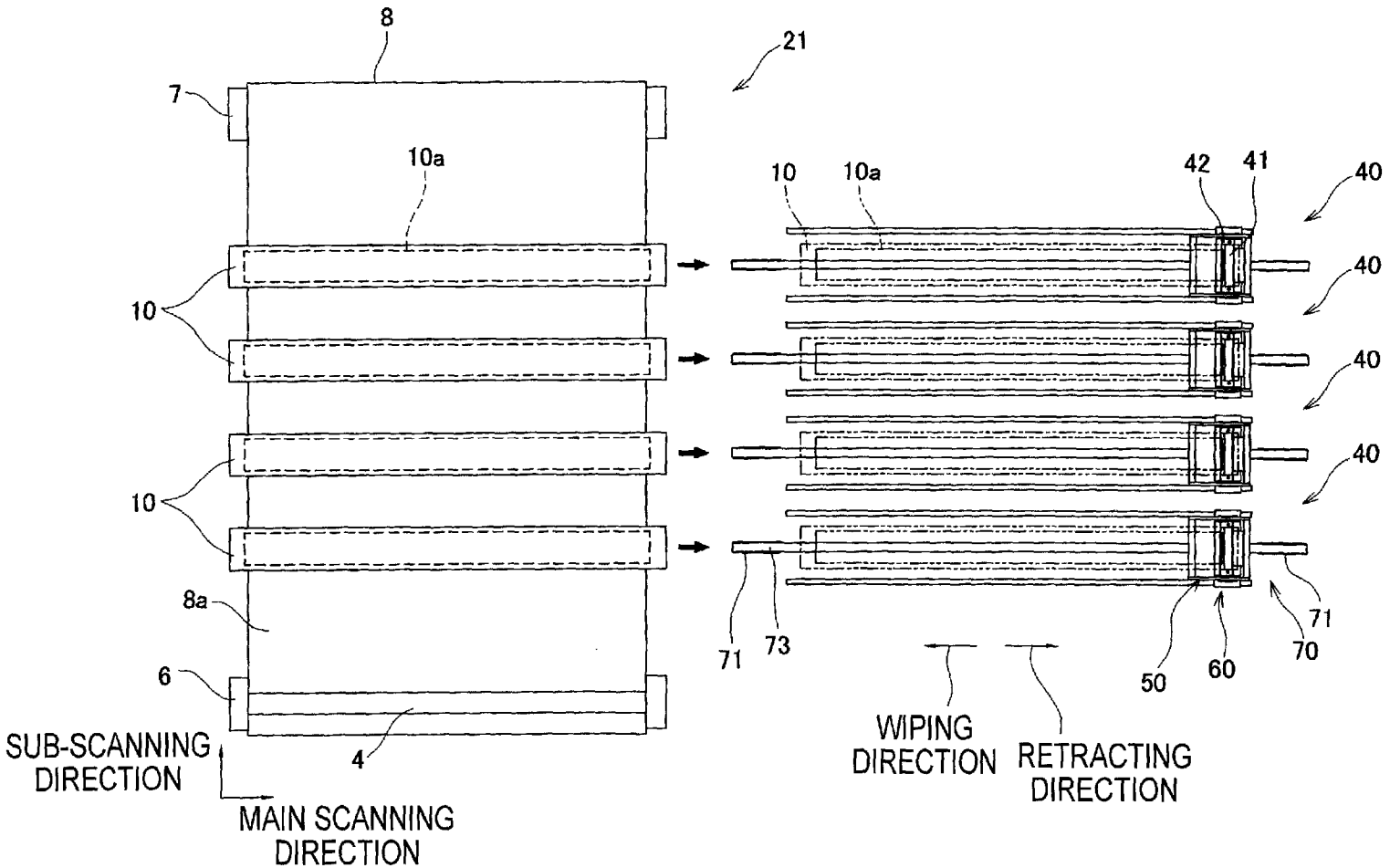
FIG. 2 is a partial plan view of the ink jet printer in FIG. 1, showing wiping devices for respective ink jet heads.

Referring to FIG. 2, the wiping devices 40 are provided for the respective heads 10. In the space A in the casing 1*a* shown in FIG. 1, the plurality of, e.g., four, wiping devices 40 are disposed side-by-side in the sub-scanning direction at the same intervals as those of the heads 10, at a side of the conveying unit 21.

Referring to FIGS. 3 to 7C, each wiping device 40 includes the wiper 41, the wiper holder 42, a cam mechanism 50, a guide mechanism 60, and a moving mechanism 70. The wiper 41 performs wiping under the control of the controller 1*p*, for example, after purge.

Figure 6A:
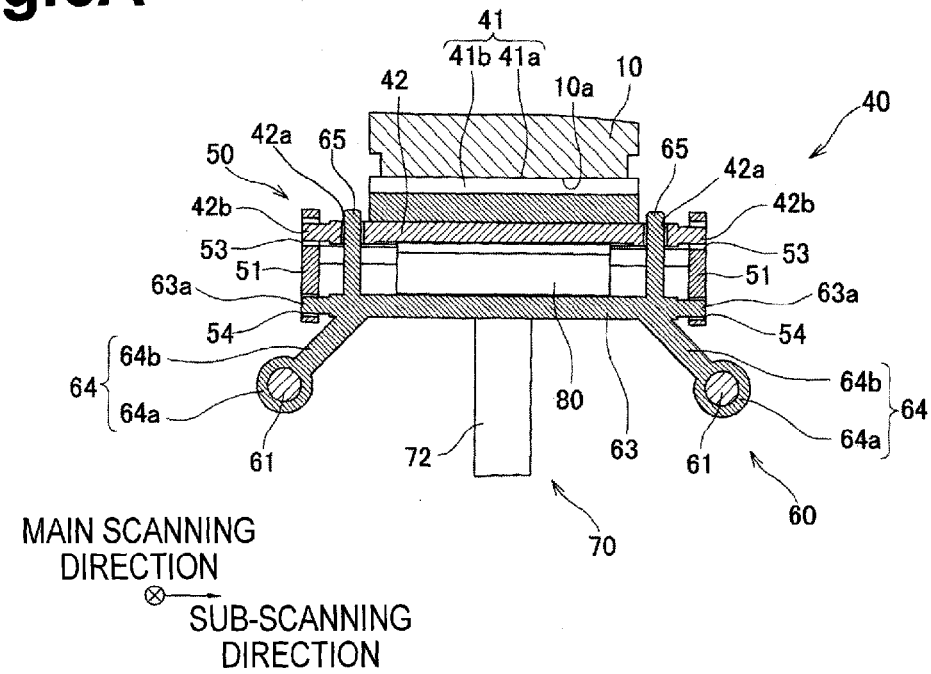
FIG. 6A is a cross-section taken along line VIa-VIa in FIG. 4.
Figure 6B:
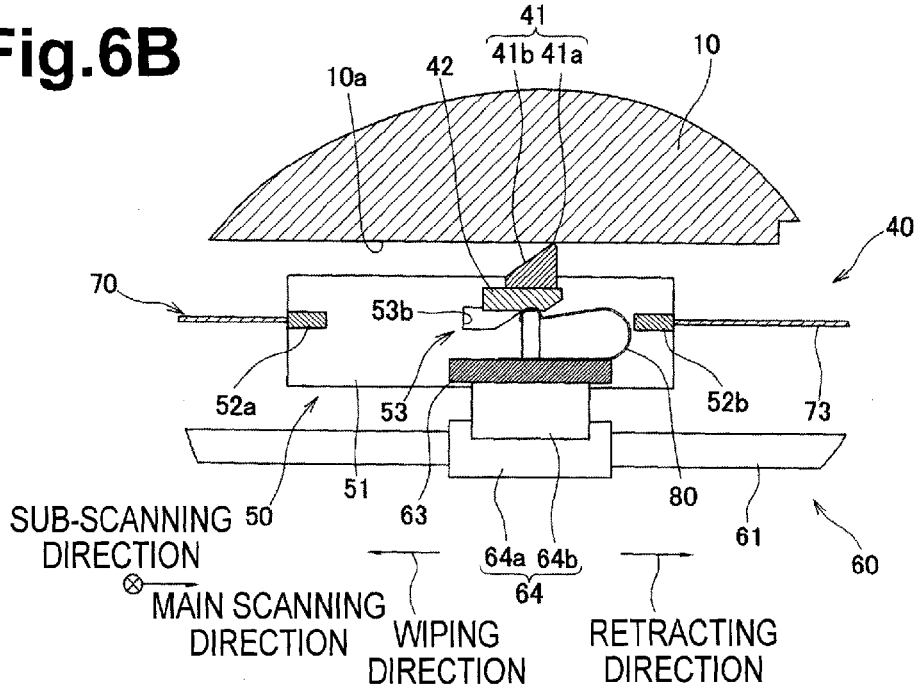
FIG. 6B is a lateral cross-section of the relevant part of the wiping device.
Figure 7A:
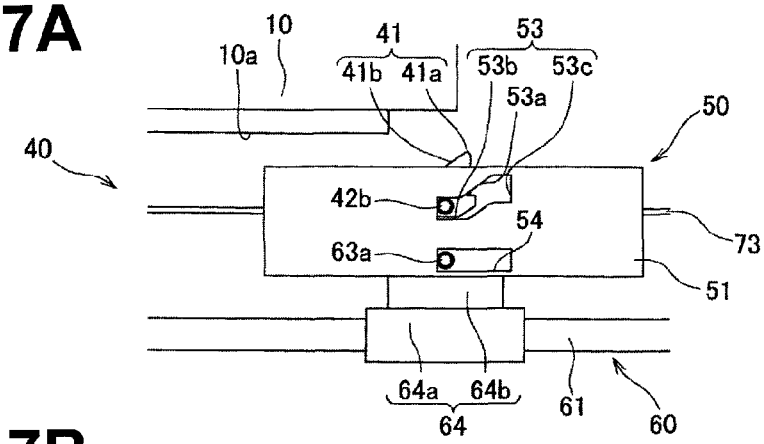
FIGS. 7A to 7C show that the wiping device is wiping the ejection surface of the head.
Figure 7B:
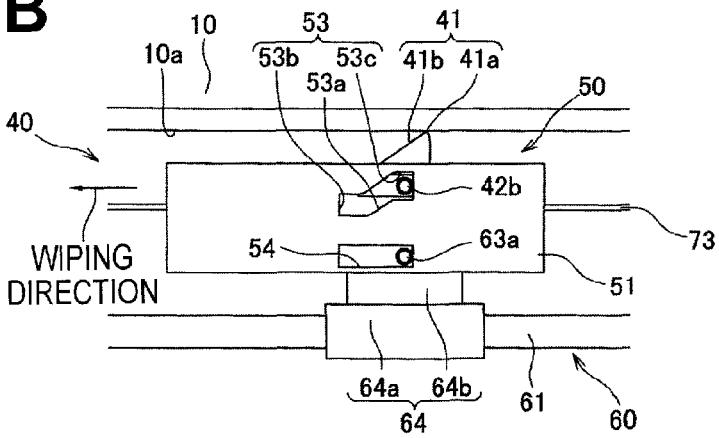
Figure 7C:
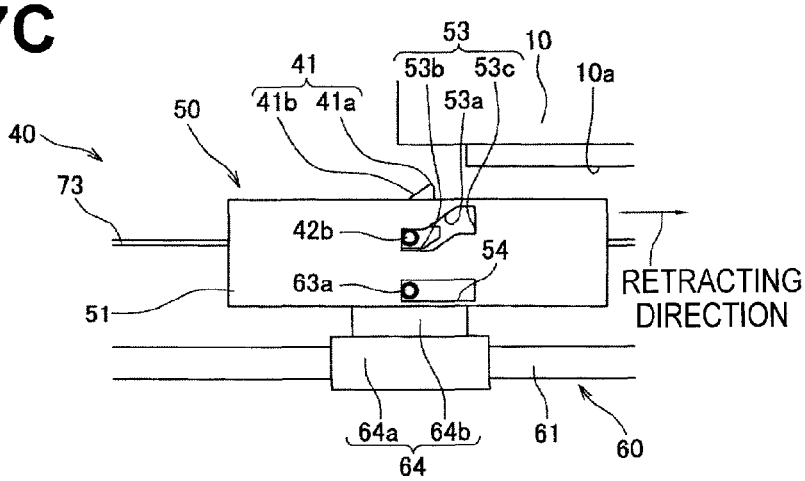

The wiper 41 is an elastic member made of, for example, rubber. The wiper 41 has a substantially right-angled triangular pole shape extending in the sub-scanning direction and is disposed such that the right-angled portion is positioned on the lower side. The wiper 41 has substantially the same length as the ejection surface 10*a* in the sub-scanning direction and has a constant lateral cross-section across the entirety in the sub-scanning direction (see FIG. 6B). Referring to FIG. 6B, the wiper 41 has an inclined surface 41*b* that is inclined away from the ejection surface 10*a*, from a tip 41*a* that is in contact with the ejection surface 10*a* during wiping toward the downstream side in the moving direction of the wiper 41 (toward the left side in FIG. 6B, hereinafter simply, "wiping direction").

The wiper holder 42 is a horizontal plate-like member to which the wiper 41 is fixed. The wiper 41 is secured to the top surface of the wiper holder 42, at the center thereof. Referring to FIG. 6A, the wiper holder 42 has a plurality of, e.g., two, holes 42*a* penetrating in the thickness direction. These holes 42*a* are formed on both sides of the part to which the wiper 41 is fixed, in the sub-scanning direction. Furthermore, the side surfaces of the wiper holder 42 in the longitudinal direction (sub-scanning direction) have projections 42*b* projecting outward in the longitudinal direction.

Figure 5:
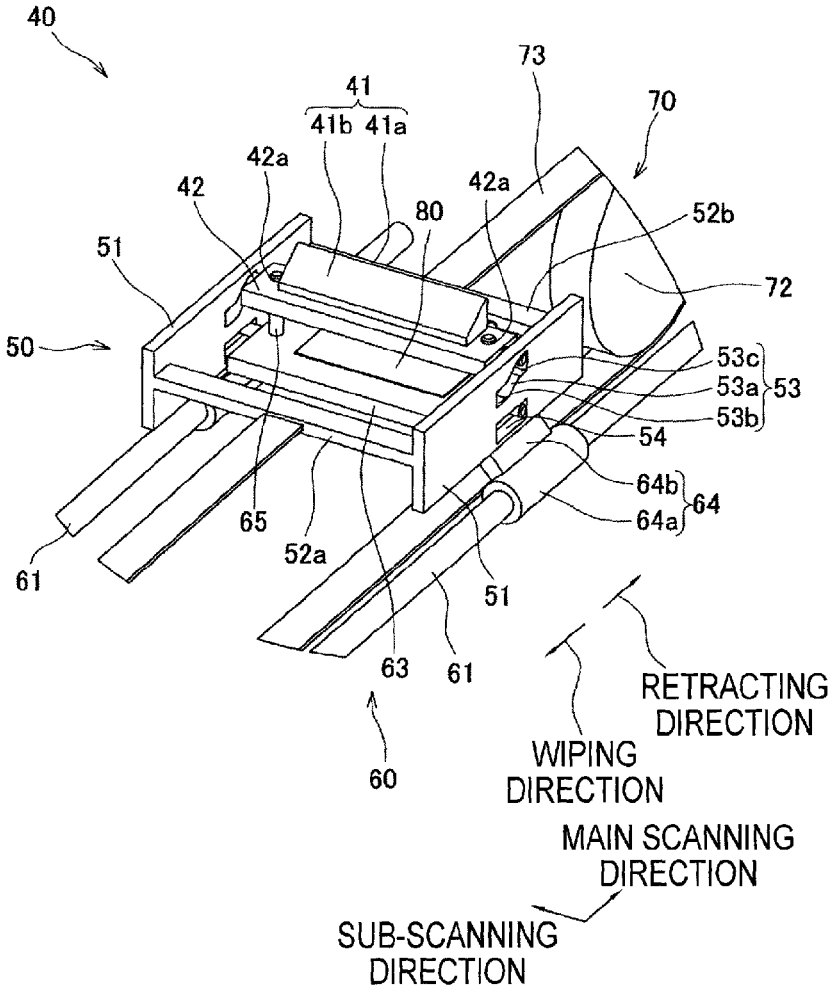
FIG. 5 is a perspective view of the relevant part of the wiping device.

Referring to FIGS. 5, 6A, and 6B, the guide mechanism 60 includes a plurality of, e.g., two, parallel shafts 61 and a horizontal plate-like member 63. The shafts 61 are poles extending in the main scanning direction. Referring to FIG. 6A, the plate-like member 63 has sliding contact portions 64 at both ends in the sub-scanning direction. The sliding contact portions 64 each include a hollow pipe 64*a* through which the shaft 61 extends and a connecting portion 64*b* connecting the hollow pipe 64*a* and the plate-like member 63. The plate-like member 63 is thus supported so as to be slidable in the main scanning direction along the shafts 61. Furthermore, a projection 63*a* projecting in the sub-scanning direction is disposed in each of the side surfaces of the plate-like member 63 in the sub-scanning direction. The plurality of, e.g., two, projections 63*a* are fitted in guide holes 54 (described below), thereby enabling the plate-like member 63 to support the cam mechanism 50 so as to be slidable in the main scanning direction.

Furthermore, the plate-like member 63 has a plurality of, e.g., two, upwardly projecting guide poles 65 on the top surface, at positions corresponding to the holes 42*a*. The guide poles 65 have an outside diameter that is slightly smaller than the inside diameter of the holes 42*a* and a length such that the upper ends thereof stay in the holes 42*a* even when the wiper 41 is positioned at a position at which it can be in contact with the ejection surface 10*a* (contacting position). Thus, the wiper holder 42 may be prevented from being shifted relative to the plate-like member 63 in the horizontal direction, when it is moved vertically.

A plate spring 80 is disposed between the plate-like member 63 and the wiper holder 42. This plate spring 80 is secured to the top surface of the plate-like member 63 at one end and to the bottom surface of the wiper holder 42 at the other end. Referring to FIG. 6B, the plate spring 80 has a horizontal U-shape with the open portion oriented toward the front in the wiping direction (downstream side). The open portion of the plate spring 80 is constantly slightly lowered toward the front in the wiping direction. Furthermore, by restraining the wiper holder 42 with guide holes 53 (described below), the plate spring 80 is compressed between the plate-like member 63 and the wiper holder 42. That is, the plate spring 80 urges the wiper holder 42 in the direction away from the plate-like member 63 (upward). The plate spring 80 is in a neutral state when the wiper 41 is positioned above the contacting position. Therefore, the plate spring 80 urges the wiper holder 42 in the direction away from the plate-like member 63 either when it is positioned at a stand-by position (described below) or when it is positioned at the contacting position. At either position, the open portion of the plate spring 80 is lowered. This reduces the height of the tip 41*a* of the wiper 41 from the top surface of the plate-like member 63, and hence, the height of the wiping device 40. Furthermore, the wiped ink flows along the inclined surface 41*b* of the wiper 41 and is discharged from the front portion in the wiping direction. Because this is also the direction in which the open portion of the plate spring 80 is oriented, the ink can be collected near the inclined surface 41*b* without staining the outside of the plate spring 80. Furthermore, the inside of the plate spring 80 is not stained by collecting ink because the open portion is lowered.

Referring to FIGS. 5, 6A, and 6B, the cam mechanism 50 includes a plurality of, e.g., two, plate-like cam plates 51 and a plurality of, e.g., two, connecting plates 52*a* and 52*b*. The plurality of, e.g., two, cam plates 51 are disposed upright on both sides of the wiper holder 42 in the sub-scanning direction. Each cam plate 51 includes the guide hole 53 fitted with the projection 42*b* and the guide hole 54 fitted with the projection 63*a*. The guide holes 53, as well as the guide holes 54, are formed so as to face each other in the sub-scanning direction. Although the guide holes 53 according to this embodiment penetrate through the cam plates 51, they may be formed as grooves that do not penetrate through the cam plates 51, as long as they can support the wiper holder 42 via the projections 42*b*. Similarly to the guide holes 53, the guide holes 54 do not have to penetrate through the cam plates 51.

Referring to FIGS. 5 to 7C, each guide hole 53 includes an inclined portion 53*a* inclined in the direction intersecting the wiping direction, along the side surface of the cam plate 51 (the surface perpendicular to the ejection surfaces 10*a*); a horizontally extending horizontal front end portion 53*b* formed at the front end (downstream end) of the inclined portion 53*a* in the wiping direction; and a horizontally extending horizontal rear end portion 53*c* formed at the rear end (upstream end) of the inclined portion 53*b* in the wiping direction. The horizontal front end portion 53*b* is disposed below the horizontal rear end portion 53*c*. That is, referring to FIG. 7A, the horizontal front end portion 53*b* is farther from the ejection surface 10*a* than the horizontal rear end portion 53*c* in the downward direction. When the projection 42*b* is positioned at the horizontal front end portion 53*b*, the wiper 41 is positioned at a separation height at which the wiper 41 cannot be in contact with the ejection surface 10*a*. In contrast, when the projection 42*b* is positioned at the horizontal rear end portion 53*c*, referring to FIG. 7B, the wiper 41 is positioned at the contacting height at which the wiper 41 can be in contact with the ejection surface 10*a*. At this time, the tip 41*a* of the wiper 41 is positioned at a height at which it slightly overlaps the ejection surface 10*a*. Thus, the cam mechanism 50 (cam plates 51) changes the height of the wiper 41, depending on the moving direction thereof. Furthermore, the guide holes 54 extend in the horizontal direction (main scanning direction), and the cam plates 51 are supported so as to be slidable in the main scanning direction via the projections 63*a*. The cam plates 51 slide by the length of the guide holes 54 relative to the plate-like member 63.

Referring to FIG. 6B, the connecting plate 52*a* is secured so as to connect the downstream ends of the cam plates 51 in the wiping direction, whereas the connecting plate 52*b* is secured so as to connect the upstream ends of the cam plates 51 in the wiping direction.

Figure 3:
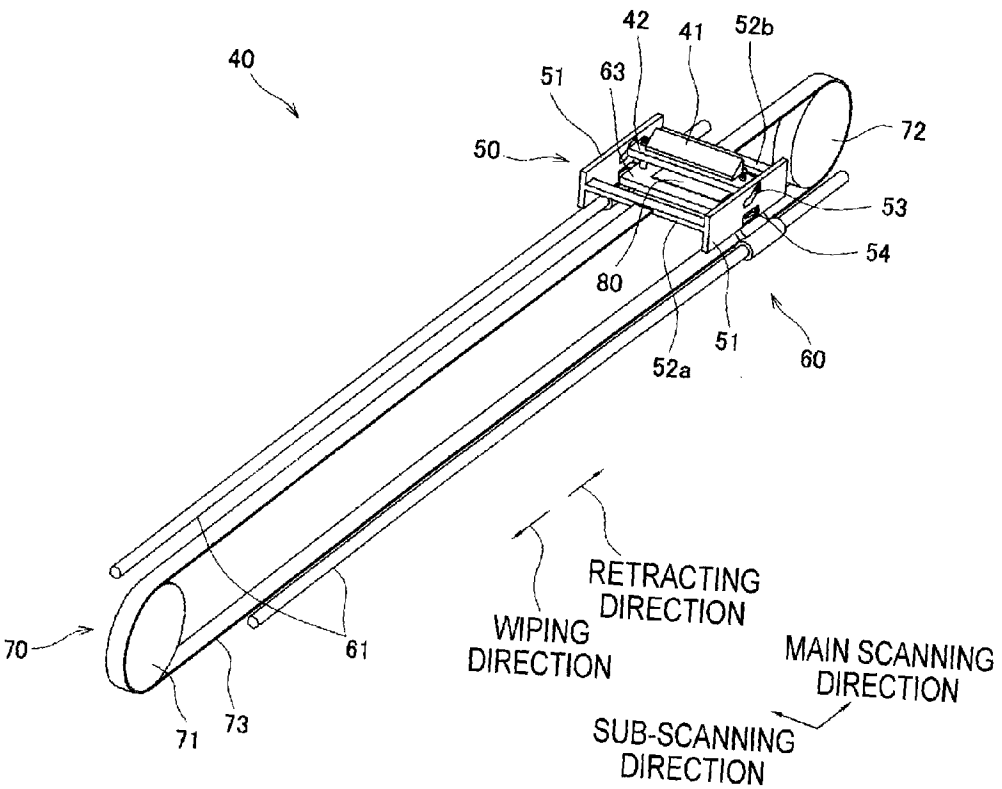
FIG. 3 is a perspective view showing the wiping device in FIG. 2.
Figure 4:
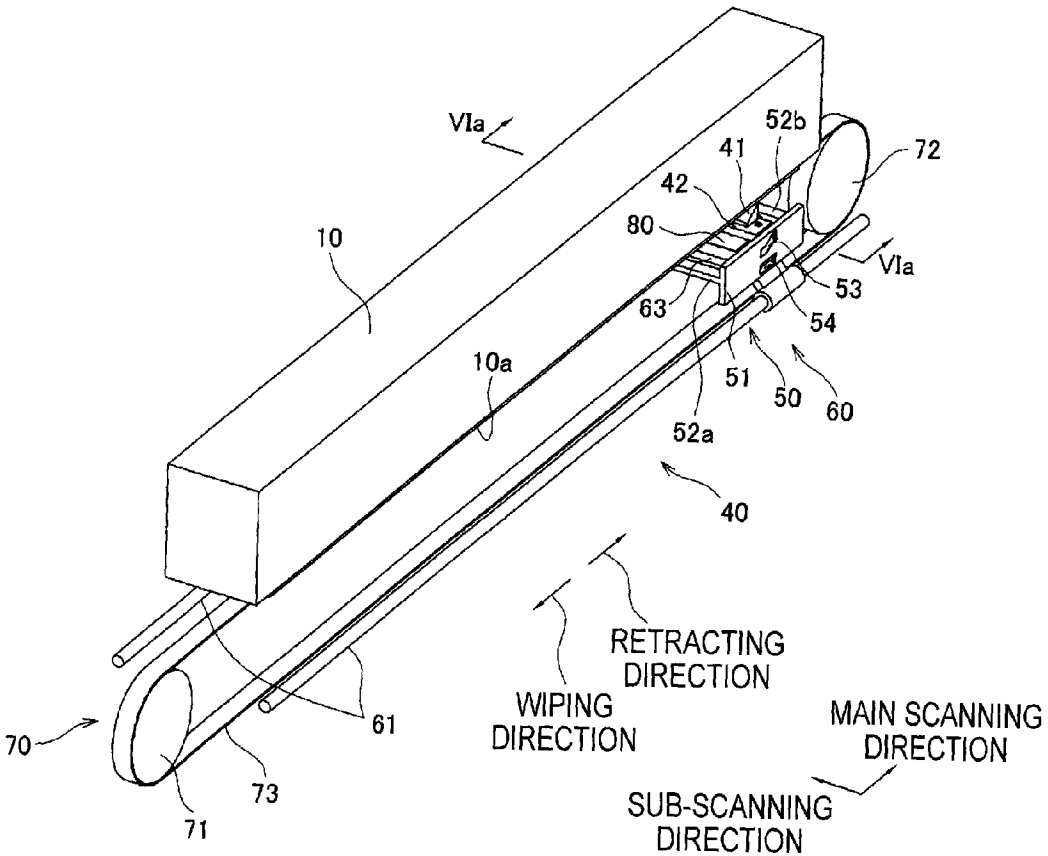
FIG. 4 is a perspective view showing a situation in which the head is disposed on the wiping device in FIG. 3 and wiper is performing wiping.

Referring to FIGS. 2 to 4, the moving mechanism 70 includes a plurality of, e.g., two, pulleys 71 and 72 spaced apart from each other in the main scanning direction, and a belt 73 stretched between the pulleys 71 and 72. Referring to FIG. 6B, the belt 73 is secured to the connecting plate 52*a* at one end and to the connecting plate 52*b* at the other end. The pulley 72 is a driving pulley and is rotated by a driving motor (not shown), under the control of the controller 1*p*. When this pulley 72 is rotated forward, the belt 73 moves in the wiping direction. At this time, the wiper 41, the wiper holder 42, the cam mechanism 50, and the like also move in the wiping direction along the shafts 61. When the pulley 72 is rotated backward, the belt 73 moves in the retracting direction opposite to the wiping direction. At this time, the wiper 41, the wiper holder 42, the cam mechanism 50, and the like also move in the retracting direction along the shafts 61. The wiping direction and the retracting direction are both parallel to the main scanning direction. Furthermore, the pulley 71 is a driven pulley and is rotated as the belt 73 moves.

Next, the operation of the respective parts of the wiping device 40 that wipes the ejection surface 10*a* of the head 10 after purge will be described.

Before wiping, the respective parts of the wiping device 40 are in stand-by mode. Referring to FIG. 2, in the stand-by mode, the wiper 41 and the like are positioned at a position farthest from the conveying unit 21 in its moving range in the main scanning direction. In other words, the wiper 41 and the like are disposed at a stand-by position. The wiper 41 at the stand-by position is disposed at the separation height when the head 10 is disposed at the maintenance position at which the head 10 opposes the wiping device 40 (the position shown in FIGS. 4 and 7A to 7C).

For example, when the purge of the head 10 is completed under the control of the controller 1*p*, and the instruction for wiping by the wiper 41 is issued, the wiping device 40 is transferred to wiping mode. At this time, in the whole conveying path, the driving of the respective parts is stopped. Furthermore, the head frame 3 is moved in the main scanning direction by the head moving mechanism (not shown) under the control of the controller 1*p*, as indicated by bold arrows in FIG. 2. In accordance with this, the head 10 is moved from the recording position (the position indicated by solid line in FIG. 2 and opposing the conveying belt 8 in the vertical direction) to the maintenance position (the position indicated by two-dot chain line in FIG. 2, see also FIG. 4).

Then, under the control of the controller 1*p*, the pulley 72 is rotated forward, causing the belt 73 to run. At this time, as the belt 73 runs, the cam plates 51 move from a retracted position in the wiping direction (to the left side in FIG. 2). The static friction between the shafts 61 and the hollow pipes 64*a* is designed to be greater than the sum of the static friction between the projections 42*b* and the inner surfaces of the guide holes 53 and the static friction between the projections 63*a* and the inner surfaces of the guide holes 54. Accordingly, at first, only the cam plates 51 are moved in the wiping direction. As the cam plates 51 move in the wiping direction, the projections 42*b* in contact with the upper corners of the horizontal front end portions 53*b* move obliquely upward while making contact with the upper portions of the inclined portions 53*a* and then come into contact with the upper corners of the horizontal rear end portions 53*c*. In other words, the wiper 41 moves from the separation height at which it cannot be in contact with the ejection surface 10*a* to the contacting height at which it can be in contact with the ejection surface 10*a*. Then, as the cam plates 51 move in the wiping direction, the wiper 41, the wiper holder 42, the guide mechanism 60, and the like move in the wiping direction along the shafts 61. Note that the cam plates 51 move only horizontally because the projections 63*a* are fitted in the guide holes 54.

When the wiper 41 arrives at a position opposing the ejection surface 10*a*, the edge of the ejection surface 10*a* comes into contact with the inclined surface 41*b* of the wiper 41. As a result, the wiper 41 and the wiper holder 42 move downward, while resisting the urging force of the plate spring 80. More specifically, referring to FIG. 7B, the projection 42*b* moves slightly away from the upper portion of the horizontal rear end portion 53*b*. Then, the tip 41*a* of the wiper 41 moves in the wiping direction while making contact with the ejection surface 10*a*. At this time, the wiper holder 42 is subjected to an upward urging force exerted by the plate spring 80. The tip 41*a* of the wiper 41 moves in the wiping direction while pressing the ejection surface 10*a* with a constant force. Accordingly, it is possible to more assuredly wipe contaminants from the ejection surface 10*a*.

Once the wiper 41 has passed the position opposing the ejection surface 10*a*, the wiper 41 and the wiper holder 42 move upward to a position at which the projections 42*b* come into contact with the upper portions of the horizontal rear end portions 53*c*. Then, by moving the wiper 41, the wiper holder 42, the cam plates 51, the guide mechanism 60, and the like to a wiping completing position (a position closest to the conveying unit 21 in the moving range in the main scanning direction) in this state, wiping of the ejection surface 10*a* by the wiper 41 is completed.

After this, under the control of the controller 1*p*, the pulley 72 is rotated backward, returning the wiper 41, the wiper holder 42, the cam plates 51, the guide mechanism 60, and the like to the retracted position. At this time too, because the static friction between the shafts 61 and the hollow pipes 64*a* is greater than the sum of the static friction between the projections 42*b* and the inner surfaces of the guide holes 53 and the static friction between the projections 63*a* and the inner surfaces of the guide holes 54, only the cam plates 51 are moved in the wiping direction. Consequently, the projections 42*b* in contact with the upper corners of the horizontal rear end portions 53*c* move obliquely downward while making contact with the upper portions of the inclined portion 53*a* and then come into contact with the upper corners of the horizontal front end portions 53*b*. In other words, the wiper 41 moves from the contacting height to the separation height. Then, in this state, as the cam plates 51 move in the retracting direction, the wiper 41, the wiper holder 42, the guide mechanism 60, and the like pass the position opposing the ejection surface 10*a* and return to the retracted position. The respective parts of the wiping device 40 thus complete the wiping operation and return to the stand-by mode.

Thereafter, the head 10 moves from the maintenance position to the recording position as the head moving mechanism moves the head frame 3. The controller 1*p*, upon receipt of a next recording instruction at this stage, activates the entire conveying path and restarts the recording operation. If the controller 1*p* does not receive a next recording instruction at this stage, it causes the ejection surface 10*a* to be covered with a cap (not shown) and waits for a next recording instruction.

As has been described above, according to the ink jet printer 1 of this embodiment, when the moving mechanism 70 moves the cam plates 51 in the wiping direction, the cam plates 51 change the height of the wiper holder 42 such that the wiper 41 is positioned at the contacting height at which the wiper 41 can be in contact with the ejection surface 10*a*. Thus, the ejection surface 10*a* can be wiped with the wiper 41. When the moving mechanism 70 moves the cam plates 51 in the retracting direction, the cam plates 51 change the height of the wiper holder 42 such that the wiper 41 is positioned at the separation height at which the wiper 41 cannot be in contact with the ejection surface 10*a*. This enables the wiper 41 to be retracted while the wiper 41 and the ejection surface 10*a* are separated. As has been described, moving the cam plates 51 in the wiping direction and the retracting direction by the moving mechanism 70 makes it possible to wipe the ejection surface 10*a* with the wiper 41 and to retract the wiper 41 while the wiper 41 and the ejection surface 10*a* are separated. In other words, moving the cam mechanism 50 by the moving mechanism 70 makes it possible to change the height of the wipers 41, without using a driving source in addition to the driving source for supplying a driving force to the moving mechanism 70. Accordingly, it is possible to reduce the number of components used in the printer body, to reduce the size of the printer body, and to reduce the manufacturing costs of the printer 1. In addition, it is possible to reduce the size of the printer body incorporating such wiping devices 40, and the manufacturing costs of the wiping devices 40 can be reduced with a reduction in the number of components.

Furthermore, because the cam mechanism 50 has a plurality of, e.g., two, cam plates 51 having the guide holes 53, the configuration is simplified.

The embodiments have been described above. However, the present invention is not limited to the above-described embodiments, and it may be variously modified within the scope described in the claims. For example, as long as the cam mechanism can change the height of the wiper depending on the moving directions, i.e., the wiping direction or the retracting direction, a structure other than the above-described cam mechanism 50 may be used. Furthermore, the plate spring 80 functioning as the urging member may be made of another elastic member, or it does not necessarily have to be provided. In addition, although the cam plates 51 have the guide holes 54 fitted with the projections 63*a* of the plate-like member 63 in the above-described embodiments, the guide holes 54 and the projections 63*a* do not necessarily have to be provided. In such a case, it is possible that the belt 73 is configured to prevent the cam plates 51 from being shaken in the vertical direction.

The recording apparatus of the present invention may be applied to both line-type recording apparatuses and serial-type recording apparatuses. Furthermore, the recording apparatus of the present invention may be applied not only to printers, but also to facsimiles and copiers. In addition, the recording head of present invention may be used to eject droplets other than ink droplets.

What is claimed is:

1. A recording apparatus comprising:

a recording head which has an ejection surface provided with ejection ports through which liquid is ejected; and a wiping device configured to move in a wiping direction along the ejection surface and wipe contaminants from the ejection surface, the wiping device comprising:

a wiper;

a wiper holder configured to hold the wiper;

a cam mechanism configured to support the wiper holder and change the height of the wiper holder, such that the wiper is positioned at a contacting height at which the wiper is in contact with the ejection surface when the cam mechanism is moving in the wiping direction, and such that the wiper is positioned at a separation height at which the wiper is not in contact with the ejection surface when the cam mechanism is moving in a retracting direction opposite to the wiping direction;

a guide mechanism configured to support the cam mechanism so as to be slidable in the wiping direction; and a moving device configured to move the wiper and the wiper holder together with the cam mechanism by moving the cam mechanism selectively in either the wiping direction or the retracting direction.

2. The recording apparatus according to claim 1, wherein the cam mechanism comprises two cam plates which sandwich and support the wiper holder in an in-plane direction of the ejection surface and a direction perpendicular to the wiping direction, wherein the cam plates have holes which support projections protruding from ends of the wiper holder in the direction perpendicular to the wiping direction, wherein the holes extend in an in-plane direction of the cam plates and a direction intersecting the wiping direction, front ends of the holes in the wiping direction being positioned farther from the ejection surface than rear ends of the holes.

3. The recording apparatus according to claim 1, wherein the guide mechanism comprises a supporting member configured to support the cam mechanism so as to be slidable in the wiping direction, and a shaft extending in the wiping direction to slidably support the supporting member, and wherein an urging member configured to urge the wiper holder in a direction away from the supporting member is disposed between the wiper holder and the supporting member.

4. A wiping device configured to wipe contaminants from an ejection surface provided with ejection ports through which liquid is ejected, by being moved in a wiping direction along the ejection surface, the wiping device comprising:

a wiper;

a wiper holder configured to hold the wiper;

a cam mechanism configured to support the wiper holder and change the height of the wiper holder, such that the wiper is positioned at a contacting height at which the wiper is in contact with the ejection surface when the cam mechanism is moving in the wiping direction, and such that the wiper is positioned at a separation height at which the wiper is not in contact with the ejection surface when the cam mechanism is moving in a retracting direction opposite to the wiping direction;

a guide mechanism configured to support the cam mechanism so as to be slidable in the wiping direction; and moving device configured to move the wiper and the wiper holder together with the cam mechanism by moving the cam mechanism selectively in either the wiping direction or the retracting direction.

* * * * *